US005447648A

United States Patent [19]

Steindorf

[11] Patent Number: 5,447,648

[45] Date of Patent: Sep. 5, 1995

[54] SOLID FOOD GRADE RINSE AID

[75] Inventor: Richard E. Steindorf, West St. Paul, Minn.

[73] Assignee: Ecolab Inc., St. Paul, Minn.

[21] Appl. No.: 223,122

[22] Filed: Apr. 5, 1994

Related U.S. Application Data

[63] Continuation of Ser. No. 863,158, Apr. 2, 1992, abandoned, which is a continuation of Ser. No. 553,158, Jul. 13, 1990, abandoned.

[51] Int. Cl.[6] ..... C11D 17/02; C11D 3/22

[52] U.S. Cl. ..... 252/90; 252/174; 252/174.17; 252/174.18; 252/DIG. 10; 252/DIG. 16

[58] Field of Search ..... 252/174.17, 174.18, 252/174, DIG. 1, DIG. 10, 90, 134, DIG. 16

[56] References Cited

U.S. PATENT DOCUMENTS

| | | | |
|---|---|---|---|
| Re. 32,818 | 1/1989 | Fernholz et al. | 252/90 |
| 3,763,047 | 10/1973 | Fairs | 252/99 |
| 3,867,301 | 2/1975 | Watanabe et al. | 252/108 |
| 3,872,020 | 3/1975 | Yamagishi et al. | 252/89 |
| 3,928,249 | 12/1975 | Nunziata et al. | 252/DIG. 1 |
| 4,142,984 | 3/1979 | Okumura et al. | 252/176.25 |
| 4,187,121 | 2/1980 | Herold et al. | 252/170 |
| 4,226,736 | 10/1980 | Bush et al. | 252/160 |
| 4,395,365 | 7/1983 | Hasegawa et al. | 252/545 |
| 4,606,775 | 8/1986 | Robinson et al. | 252/92 |
| 4,624,713 | 11/1986 | Morganson et al. | 134/25 |
| 4,762,637 | 8/1988 | Aronson et al. | 252/186.34 |
| 4,849,132 | 7/1989 | Fujita et al. | 252/174.17 |
| 4,863,632 | 9/1989 | Aronson et al. | 252/186.34 |
| 4,908,148 | 3/1990 | Caravajal | 252/135 |
| 5,002,758 | 3/1991 | Ichii et al. | 252/142 |
| 5,089,162 | 2/1992 | Rapisarda et al. | 252/102 |
| 5,320,118 | 6/1994 | Fernholz | 134/93 |

FOREIGN PATENT DOCUMENTS

| | | |
|---|---|---|
| 49-126703 | 12/1974 | Japan . |
| 50-62211 | 5/1975 | Japan . |
| 51-68608 | 6/1976 | Japan . |

OTHER PUBLICATIONS

Martin Schick, *Nonionic Surfactants,* Marcel Dekker, Inc. New York, Mar. 1967, pp. 275–276.

Derwent Publications Accession No. 75–18489W, for JP 5004 002, Feb. 13, 1975.

Chemical Abstracts No. for 98:18495y, JP 57,135,900, Dec. 9, 1981.

Derwent Publications Accession No. 75–19996W, for JP 49090706, Aug. 29, 1974.

Chemical Abstracts No. 104:111860r, for JP 60,120,800 Jun. 28, 1985.

Nikkol Data Sheet, Nikko Chemicals Co., Ltd.-*Polyglyceryl Fatty Acid Ester,* Jan. 7, 1991.

Nikkol, Nikko Chemicals Co., Ltd., *Product Data Sheet on Sorbitan Fatty Acid Esters,* Jan. 7, 1991.

*Ryoto Sugar Ester Technical Information,* Jan. 7, 1991.

Nikkol *Data Sheet on Fatty Acid Esters,* Jan. 7, 1991.

*Primary Examiner*—Paul Lieberman
*Assistant Examiner*—Ardith Hertzog
*Attorney, Agent, or Firm*—Merchant, Gould, Smith, Edell, Welter & Schmidt

[57] ABSTRACT

A concentrated, extremely active, solid, food grade rinse aid which includes a sorbitan fatty acid ester, a sucrose fatty acid ester, a polyglycerol fatty acid ester, a water soluble filler, and optionally a processing aid.

15 Claims, 2 Drawing Sheets

(TESTING APPARATUS)

(TESTING APPARATUS)

SOLID FOOD GRADE RINSE AID

This is a continuation, of application Ser. No. 07/863,158, filed Apr. 2, 1992, now abandoned, which is a File Wrapper continuation application of U.S. Ser. No. 07/553,158, filed Jul. 13, 1990, now abandoned.

FIELD OF THE INVENTION

The invention relates to solid food grade rinse aids and methods of warewashing which include a step of rinsing the cleaned dishes with a rinse solution created from a solid food grade rinse aid.

BACKGROUND OF THE INVENTION

Institutional and consumer automatic dishwashers or warewashing machines typically provide two or more stages which include various combinations of a soak, a prewash, a main wash, a rinse, a sanitizing cycle and a drying cycle.

Dishes washed in automatic dishwashers or warewashing machines are preferably obtained without food soils and without residue from the cleaning solutions or other chemical(s) used in the washing process. One type of residue, known as streaking and spotting, is common on machine washed dishes. Streaking and spotting is believed to result when water remains attached to the dishes after the rinse cycle and then evaporates from the surface of the dishes.

Rinse agents are commonly added to rinse water in an effort to reduce the surface tension of the rinse water and thereby promote sheeting of the water from the dishes. Typical rinse aid formulas require a solution concentration of about 1000 ppm to provide efficient sheeting and drying.

Rinse aids are currently available in liquid or solid form. Solid rinse aids are generally preferred for a variety of reasons including manufacturing cost, manufacturing and dispensing convenience, and dispensing safety. In addition, dispenser units for solid rinse aids tend to be less expensive and more durable because they require fewer moving parts.

One of the difficulties encountered in the use of a rinse aid is that the rinse cycle is typically the last cycle in the warewashing process which permits solubilized particles of the rinse agent to remain on the cleaned dishes. Because of the obvious possibility for ingestion of residual rinse aid, it is desirable that such residue be of food grade quality.

Typical liquid rinse aids are disclosed in Japanese Application Nos. 48-38588 and 48-112123. Japanese Application No. 48-38588 discloses a liquid rinse agent which includes a sucrose acid ester, a sorbitan acid ester, a monohydric alcohol such as ethanol, a polyhydric alcohol such as ethylene glycol, and optionally water. Japanese Application No. 48-112123 discloses a liquid rinse aid which includes a major proportion of a sorbitan ester, a minor proportion of a monohydric or polyhydric alcohol, and optionally an aliphatic acid and/or water. While such liquid rinse agents are generally effective for preventing streaking and spotting, they suffer from the general drawbacks associated with liquid rinse agents and further suffer from uncontrollable excessive consumptions of the rinse agent due to the relatively high solubility of the compound.

Many of the currently available solid rinse aids contain a polyalkylene oxide surfactant which is commonly a polyoxyethylene-polyoxypropylene block copolymer.

Some of these polyoxyethylene-polyoxypropylene block copolymer, while generally effective for preventing streaking and spotting, can coagulate within the dishwashing machine at elevated temperatures. Such coagulation of the block copolymer enhances the ability of the copolymer to remain attached to the surface of the dishes during the rinse cycle and thereby encourages retention of the rinse agent on the clean dishes and can cause visible spotting upon the dishes.

Accordingly, a substantial need exists for a solid, concentrated, food grade, rinse aid which is effective for eliminating spotting and streaking at relatively low solution concentrations and provides a controllable dispensing rate.

BRIEF DESCRIPTION OF THE INVENTION

The present invention is a, concentrated, low foaming, solid rinse aid composition formulated from food grade components which is effective for controlling spotting and streaking at relatively low solution concentrations and has a relatively low solubility rate which facilitates controlled dispensing. The solid rinse aid consists essentially of about 2 to 20 wt % of a sorbitan aliphatic ester, 35 to 65 wt % a sucrose aliphatic ester, about 2 to 20 wt % of a polyglycerol fatty acid ester, and about 5 to 40 wt % of a water soluble filler. Optionally, the solid rinse aid may include up to about 10 wt % of a processing aid for facilitating homogeneous processing of the composition.

The rinse aid composition is effective for significantly reducing spotting and streaking at solution concentrations of about 20 to 250 ppm with optimum performance occurring at concentrations of about 50–150 ppm. Such reduced solution concentrations simplifies dispensing of the rinse aid and decreases foaming.

Because the rinse aid is in solid form it eliminates the need for carrier solvents such as an alcohol which are commonly used with liquid forms for facilitating dispensing of the rinse aid.

DETAILED DESCRIPTION OF THE INVENTION INCLUDING A BEST MODE

Figure 1:
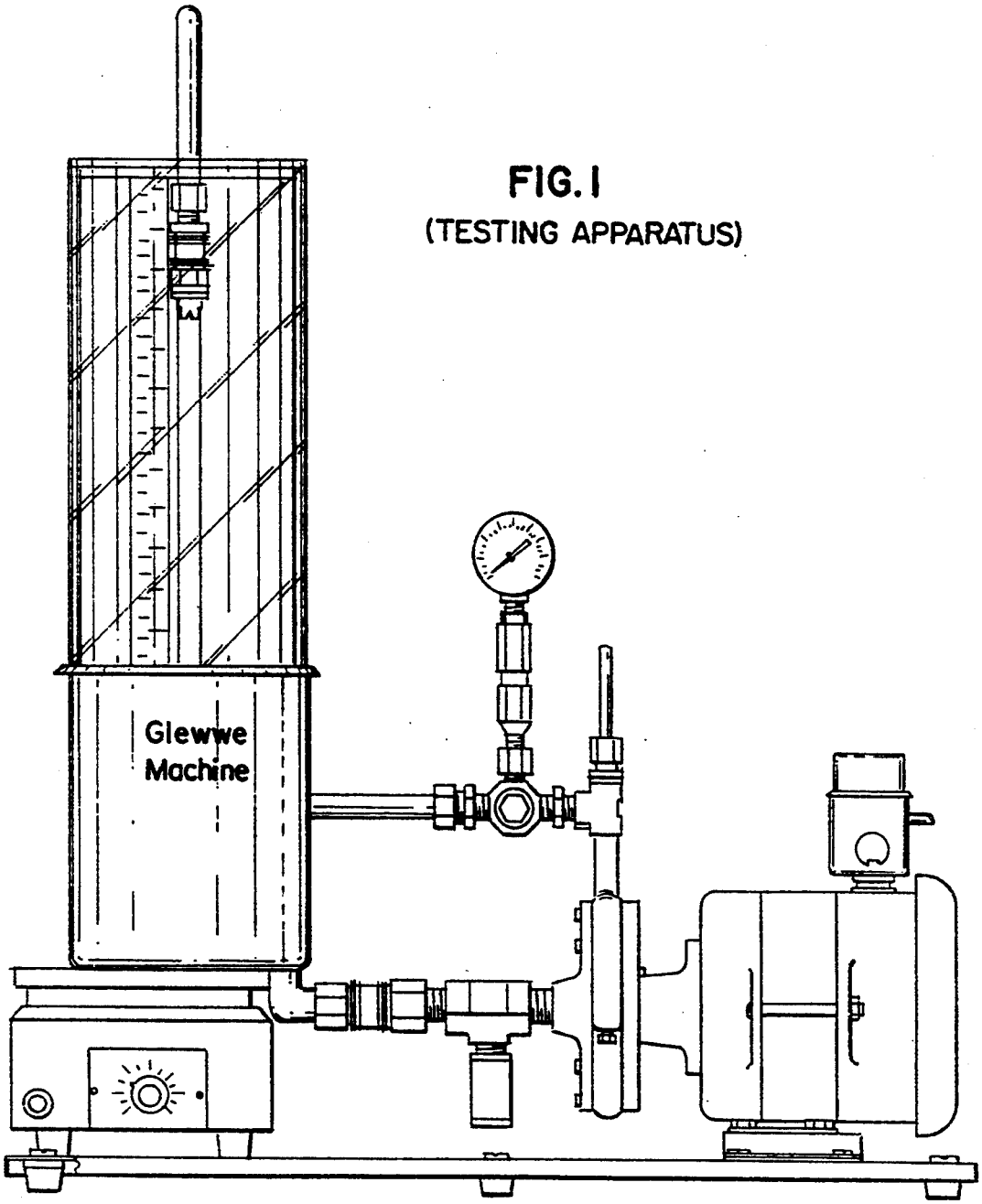

The invention is a solid rinse aid which is effective at a concentration of about 20–200 ppm in rinse water for preventing the spotting and streaking of dishes commonly associated with the machine washing of dishes. Broadly, the rinse aid composition includes at least one sorbitan aliphatic ester, at least one sucrose aliphatic ester, and at least one water soluble food grade filler. The composition may optionally include at least one polyglycerol fatty acid ester for enhancing performance and solidifying the composition, and a processing aid. Since all components are food grade, the rinse aid composition alleviates any health concerns associated with residual deposits of the composition upon the cleaned dishes.

As used herein, including the claims, the term "dishes" is employed in the broadest sense to refer to the various types of articles used in the preparation, serving and consumption of foodstuffs including pots, pans, trays, pitchers, bowls, plates, saucers, cups, glasses, forks, knives, spoons, spatulas, and the like.

Sorbitan Aliphatic Ester

Sorbitan aliphatic esters suitable for use in the rinse aid composition include any sorbitan aliphatic ester capable of providing effective foam control and cooperating with the other components for producing a solid rinse aid composition. One group of particularly suitable sorbitan aliphatic esters are the sorbitan fatty acid esters. Sorbitan fatty acid esters can provide effective sheeting action and rinsing performance.

Sorbitan fatty acid esters suitable for the use in the rinse aid composition include mono-, di-, tri- and tetra-esters and mixtures thereof. Sorbitan fatty acid esters may be derived by esterification of sorbitol with such fatty acids as lauric, myristic, palmitic, stearic, oleic, linoleic, and similar saturated and unsaturated, branched and straight chain fatty acids. Preferably, the fatty acids are $C_{6-24}$ straight chain fatty acids having less than 3 unsaturated carbon bonds. Based upon cost, availability and ability to provide excellent sheeting action and rinsing performance, the preferred useful sorbitan fatty acid esters include monoesters such as sorbitan monocaprylate acid, sorbitan monolaurate, sorbitan monopalmitate, sorbitan monostearate, sorbitan monooleate, sorbitan monolinoleate, sorbitan monoeleostearate, sorbitan monopentadecanoic acid ester, sorbitan monoheptadecanoate; diesters such as sorbitan sesquistearate and sorbitan sesquioleate; tri esters such as sorbitan tristearate and sorbitan trioleate.

Because of the difficulty encountered in attempting to purify sorbitan fatty acid esters from the reaction mixture, the sorbitan fatty acid ester will typically contain various amounts of sorbitol fatty acid ester(s), sorbide fatty acid ester(s) and trace quantities of sorbitan, sorbitol, sorbide and fatty acid(s). Sorbitan fatty acid esters containing such "contaminants" may be effectively employed in the rinse aid composition without significant adverse effect.

Sucrose Aliphatic Ester

Sucrose aliphatic esters suitable for use in the rinse aid composition include any sucrose aliphatic ester capable of contributing to the sheeting action and rinsing performance of the composition and cooperating with the other components for producing a solid rinse aid composition. Sucrose has a total of eight reactive hydroxyl groups which are subject to substitution.

One group of particularly suitable sucrose aliphatic esters are the sucrose fatty acid esters which are generally solid at room temperature and can also assist in solidifying the composition. The sucrose fatty acid esters suitable for the use in the rinse aid composition include mono to octa fatty acid esters and mixtures thereof. Sucrose fatty acid esters may be derived by esterification of sucrose with such saturated fatty acids as acetic, propionic, butyric, valeric, caproic, enanthic, caprylic, pelargonic, capric, lauric, myristic, palmitic, and stearic; unsaturated fatty acids such as palmitoleic, oleic, vaccenic, linoleic, sorbic, linolenic, and arachidonic; and similar saturated and unsaturated, branched and unbranched fatty acids.

Sucrose fatty acid esters are readily available from a number of sources including Mitsubishi-Kasei Foods Corporation of Tokyo, Japan under the designation Ryoto Sugar Esters, and Dai-ichi Kogyo Seiyaku Company Ltd. of Tokyo, Japan.

The preferred sucrose fatty acid ester for use in the rinse aid composition is a mixture of about 2 to about 12 wt % sucrose laurate and about 25 to about 85 wt % sucrose palmitate. Such a mixture provides effective sheeting action and rinsing performance while contributing to the formation of a solid product with beneficial dispensing characteristics.

The sucrose laurate and sucrose palmitate may be provided as monoesters, diesters, triesters, tetraesters, pentaesters, hexaesters, heptaesters, octaesters and mixtures thereof. However, I have discovered that the shelf life and performance of the of the rinse aid composition is enhanced when at least about 70% of the sucrose palmitate is a monoester and at least about 80% of the sucrose laurate is a monoester.

Polyglycerol Aliphatic Ester

Polyglycerol aliphatic esters suitable for use in the rinse aid composition include any polyglycerol aliphatic ester capable of contributing to the sheeting action and rinsing performance of the composition and cooperating with the other components for producing a solid rinse aid composition.

One group of particularly suitable polyglycerol aliphatic esters are the polyglycerol fatty acid esters. Suitable polyglycerol fatty acid esters include specifically, but not exclusively, those derived by esterification of a polyglycerol with such saturated fatty acids as acetic, propionic, butyric, valeric, caproic, enanthic, caprylic, pelargonic, capric, lauric, myristic, palmitic, and stearic; unsaturated fatty acids such as palmitoleic, oleic, vaccenic, linoleic, sorbic, linolenic, and arachidonic; and similar saturated and unsaturated, branched and unbranched fatty acids.

Polyglycerol fatty acid esters are readily available from a number of sources including Nikko Chemicals Company, Ltd of Tokyo, Japan, and Toho Chemical Industry Company, Ltd. of Tokyo, Japan.

Because of the relatively low cost, ready availability, sheeting performance, and ability to provide a rinse aid composition with beneficial dispensing characteristics, the preferred polyglycerol fatty acid ester for use in the rinse aid composition is decaglycerol monolaurate available from Nikko Chemicals Company, Ltd of Tokyo, Japan under the mark Decaglyn 1-L.

The polyglycerol aliphatic ester may be effectively used within the rinse aid composition at a concentration of about 2 to about 20 wt %. Concentration outside of this range tend to provide minimal sheeting performance or excessive foaming.

Optional Polyol Fatty Acid Esters

The food grade rinse aids of the invention may also contain one or more additional food grade fatty acid esters of other polyols such as glycerine, glycerol, diglycerol, triglycerol, glyceraldehyde, erythrose, threose, ribose, arabinose, xylose, glucose, mannose, galactose, ribulose, xylose, fructose, lactose, maltose, cellobiose, and the like. Such polyol fatty acid esters are useful for contributing to the sheeting action and rinsing performance of the composition and cooperating with the other components for producing a solid rinse aid composition.

Fillers

One or more solid, water soluble, food grade fillers may be employed in the rinse aid composition for adjusting the hardness and/or solubility of the composition without significantly interfering with the desired functioning of the other components. Fillers are also useful for adjusting the concentration of active components in the composition and thereby enhancing control over dispensing of the composition. Many different types of fillers may be used in the rinse aid composition including specifically, but not exclusively; sugars such as glucose, fructose and sucrose; alkali metal salts such as sodium chloride, potassium chloride, sodium carbonate, sodium bicarbonate, sodium sulfate, potassium sulfate, sodium acetate, sodium lactate; water soluble amino acids such as alanine, arginine, glycine, lysine and proline; and phosphates such as tetrasodium pyrophosphate. Because of the low cost, ready availability, and ability to produce a solid composition having a beneficial dispensing rate, the preferred fillers are the phosphates and mixtures of phosphates and alkali metal salts with a mixture of tetrasodium phosphate and sodium chloride most preferred based upon cost, availability, ability to harden the resultant composition, and ability to function as a threshold agent.

The percentage of filler which may be usefully employed in the rinse aid composition is dependent upon a number of factors including the particular filler employed, the types and amounts of other components employed, and the environmental conditions expected to be encountered during manufacture, storage and dispensing. Generally, inclusion of about 5 to about 40 wt % filler in the rinse aid composition is sufficient to achieve the desired results. When sucrose and/or sodium chloride is employed as the filler, the rinse aid composition preferably includes about 5 to about 20 wt-% tetrasodium pyrophosphate and/or about 2 to about 10 wt % sodium chloride with a total of tetrasodium pyrophosphate and sodium chloride of about 5 to about 30 wt %.

Amino acids are useful as fillers when solidification difficulties are encountered as they tend to develop a strong crystal lattice structure within the composition which facilitates hardening.

Processing Aids

Processing aids effective for providing the initial mixture with a workable viscosity at elevated temperatures of about 80° to 150° C. may be employed when necessary. Suitable processing aids capable of modifying the viscosity of the composition mixture during processing without substantially interfering with solidification of the composition or the functioning of the other components include specifically, but not exclusively, propylene glycol, glycerine, sorbitol and the like. Selection of the quantity of processing aid to employed in the composition mixture requires a balancing of the competing interests of workability (increased amount of processing aid=increased workability) and dispensability (increased amount of processing aid=increased softening and flowing of composition during dispensing). Generally, a concentration of about 2 to about 15% provides an effective balance between these interests so as to provide a composition which is solid at ambient temperatures of about 25° to 75° C. and workable at temperatures of about 80° to about 150° C. Because of the relatively low cost, ease of availability, compatibility with the other components, and effectiveness for modifying the processing viscosity without substantially interfering with solidification, the preferred processing aid is propylene glycol.

Processing

The individual components may be combined in any desired sequence. However, because of the highly viscous nature of the molten composition it is generally desired to combine and blend the solid components at room temperature prior to adding the liquid components.

The composition may be mixed by any means capable of handling the high viscosities associated with the molten composition including both batch and continuous mixers. It is believed that the composition may be conveniently mixed in an extruder equipped with a heating jacket.

I have observed that heating the composition to temperatures in excess of about 230°-250° F. results in a product which is harder than that obtained by heating the composition to a temperature of about 190° to about 200° F.

Dispensing

The product may be conveniently dispensed by inserting the cast solid material in a spray-type dispenser such as the SOLET TM rinse additive dispenser manufactured by Ecolab, Inc. of St Paul, Minn. Spray type dispensers function by directing a water spray from a spray nozzle onto a solid block of material which is retained above the spray nozzle by a screen. The water spray dissolves a portion of the solid block of material and forms a concentrated solution which is then immediately directed to the point of use.

The rinse agent must possess sufficient structural integrity under prolonged conditions of high heat (140° to 180° F.) and high humidity (dew points of 100° to 180° F.) to permit controlled dispensing of the agent from a spray type dispenser.

The concentration of rinse aid in the rinse water may be regulated by controlling the amount of rinse water sprayed onto the rinse additive (simple) or the amount of rinse aid actually dissolved (complicated). The amount of rinse aid actually dissolved may be measured automatically or manually by measuring the volume of concentrated rinse solution formed (measured with a flow meter) and the concentration of rinse aid in the concentrated rinse solution (measured with an electrode).

The description is provided to aid in a complete nonlimiting understanding of the invention. Since many variations of the invention may be made without departing from the spirit and scope of the invention, the breadth of the invention resides in the claims hereinafter appended.

Experimental

Examples

Each of the compositions listed in Table 1 were prepared by mixing the listed components in a beaker with the powdered/granular components blended prior to addition of the liquid components. The component L-1695 TM, when employed, was powdered with a mortar and pestle prior to blending in the beaker. A thermometer was placed in the beaker and the mixture heated in a microwave oven to a temperature of between about 190° F. to about 250° F. (unrecorded) with occasional removal and stirring of the heating mixture with a spatula. The heated mixture was then scraped from the beaker into one or more plastic cups, allowed to cool and solidify at room temperature, and removed from the cup. Observations as to the physical characteristics of the resultant composition are provided in Table 2.

Sheeting performance of the resultant compositions were tested in accordance with the protocol set forth below as "Testing Procedure—Sheeting Performance". Results of the sheeting performance tests are provided in Table 3.

The foaming characteristic of several of the resultant compositions was tested in accordance with the protocol set forth below as "Testing Procedure—Foaming". Results of the foaming tests are provided in Table 4.

The dispensing characteristics of several of the resultant compositions were tested in accordance with the protocol set forth below as "Testing Procedure—Dispensing". Results of the dispensing tests are provided in Table 5.

TABLE 2-continued

| | |
|---|---|
| | sucrose monopalmitate available from the Mitsubishi Chemical Industries, Ltd. through the distributor Mitsubishi-Kasei Food Corporation under the group mark Ryoto Sugar Ester. |
| L-1695 TM | A sucrose laurate containing about 80 wt % sucrose monolaurate available from Mitsubishi Chemical Industries, Ltd. through the distributor Mitsubishi-Kasei Food Corporation under the group mark Ryoto Sugar Ester. |

TABLE 1

| Comp # | SK-10 (g/%) | SL-10 (g/%) | P1570S (g/%) | L-1695 (g/%) | S-1170 (g/%) | F-90 (g/%) | 1-M (g/%) | 1-L (g/%) | 3-1-S (g/%) | TSPP (g/%) | NaCl (g/%) | sucrose (g/%) | glycine (g/%) | Other (g/%) |
|---|---|---|---|---|---|---|---|---|---|---|---|---|---|---|
| 1 | 30/10 | | 165/55 | 30/10 | | | 30/10 | | | 30/10 | 15/5 | | | |
| 2 | 30/10 | | 150/50 | 21/07 | | | | 21/07 | | 30/10 | 48/16 | | | |
| 3 | 135/10 | | 675/50 | 94/07 | | | | 108/08 | | 135/10 | 202/15 | | | |
| 4 | 225/12 | | 900/50 | | 225/12 | | | | | | 180/10 | 180/10 | | 90/05 (polyglycol) |
| 5 | 12/25 | | 12/25 | | 05/10 | | | | 05/10 | | | | 05/10 | 10/20 ($Na_2SO_4$) |
| 6 | 05/10 | | 20/40 | | 05/10 | | | | 05/10 | | | | 05/10 | 10/20 ($Na_2SO_4$) |
| 7 | 20/40 | | | | 07/15 | 02/05 | | | 05/10 | | | | 05/10 | 10/20 ($Na_2SO_4$) |
| 8 | 15/30 | | 05/10 | | 10/20 | | | | 05/10 | | | | 05/10 | 10/20 ($Na_2SO_4$) |
| 9 | 12/25 | | 10/20 | | 07/15 | | | | 05/10 | | | | 05/10 | 10/20 ($Na_2SO_4$) |
| 10 | 30/10 | | 120/40 | | 30/10 | | | | 30/10 | | | | 30/10 | 60/20 ($Na_2SO_4$) |
| 11 | 31/12 | | 125/50 | | 31/12 | | | | | | 25/10 | 23/10 | | 12/5 ($C_3$ glycol) |
| 12 | 06/12 | | 25/50 | | 7/15 | | | | | | 7/15 | | | 03/07 ($C_3$ glycol) |
| 13 | 05/10 | | 20/40 | | 6/13 | | | | | | 7/15 | | | 08/17 (1-S) 02/05 ($C_3$ glycol) |
| 14 | 18/36 | 07/14 | | | | | | | | | | | 07/15 | 02/05 (P-1670) 12/25 ($Na_2SO_4$) 02/05 ($H_2O$) |

TABLE 2

| Composition # | Comments |
|---|---|
| 1 | Molten mixture is highly viscous. |
| 2 | |
| 3 | Resultant product is a tanish, homogeneous solid. |
| 4 | Molten mixture is highly viscous. Manual smoothing required to flatten top of cast product. |
| 5 | Resultant product is more of a paste than a solid. |
| 6 | Resultant product is a hard solid. |
| 7 | Resultant product is a soft solid. Dissolves slowly in hot water. |
| 8 | Resultant product is a moderately hard solid. |
| 9 | Resultant product is a moderately hard solid. |
| 10 | Resultant product is a hard solid. |
| 11 | Resultant product difficult to remove from cup. |
| 12 | Resultant product difficult to remove from cup. |
| 13 | Resultant product difficult to remove from cup. Required soaking in hot water to remove. |
| 14 | Resultant product is a soft solid. |

Nomenclature

| | |
|---|---|
| SK-10 TM | A sorbitan monocaprylate available from the Nikko Chemicals Company, Limited of Tokyo, Japan. |
| SL-10 TM | A sorbitan monolaurate available from the Nikko Chemicals Company, Limited of Tokyo, Japan. |
| P1570S TM | A sucrose palmitate containing about 70 wt % |
| S-1170 TM | A sucrose stearate containing about 55 wt % sucrose monostearate available from Mitsubishi Chemical Industries, Ltd. through the distributor Mitsubishi-Kasei Food Corporation under the group mark Ryoto Sugar Ester. |
| F-90 TM | A powdered sucrose fatty acid ester available from Daiichi Kogyo Seiyaku Company of Tokyo, Japan. |
| 1-M TM | A decaglyceryl monomyristate available from Nikko Chemicals Company, Limited of Tokyo, Japan under the group mark Decaglyn TM . |
| 1-L TM | A decaglyceryl monolaurate available from Nikko Chemicals Company, Limited of Tokyo, Japan under the group mark Decaglyn TM . |
| 3-1-S TM | A triglycerol monostearate available from the Durkee Industrial Foods Corp. of Cleveland, Ohio under the group mark Santon TM . |
| TSPP | tetrasodium pyrophosphate. |
| NaCl | sodium chloride. |
| C3 glycol | propylene glycol |
| 1-S TM | A decaglyceryl monostearate available from Nikko Chemicals Company, Limited of Tokyo, Japan under the group mark Decaglyn TM . |
| P-1670 TM | A sucrose palmitate containing about 80 wt % sucrose monolpalmitate available from Mitsubishi Chemical Industries, Ltd. through the distributor Mitsubishi-Kasei Food Corporation under the group mark Ryoto Sugar Ester. |

Sheeting Performance

Testing Procedure

Procedure

A test rack was assembled by positioning (i) a 10 inch melmac plate [MP], (ii) a Syracuse china plate [CP], (iii) a 5½×5½ inch plate glass slide [GS], (iv) a stainless steel knife retained in a vertical position by a rubber band [SK], (v) a 6×4 inch stainless steel sheet [SS], and (vi) a glass tumbler [GT] in a standard plastic dishwashing rack such that none of the test pieces are touching.

A soiling mixture was made by mixing 4 parts margarine and 1 part powdered nonfat milk.

The reservoir (96.4 liters) of a Champion 1-KAB TM dishwashing machine manufactured by Champion Industries of Winston Salem, N.C., modified with a clear plexiglass wall, was filled with hot tap water and 380 grams of Guardian Plus TM, an alkaline detergent composition manufactured by Ecolab, Inc. of St. Paul, Minn. dissolved in the water. The test rack was placed in the machine and the machine cycled once through the cleaning cycle to ensure that all of the test pieces were clean. After completion of the cleaning cycle the machine reservoir was drained.

The machine reservoir was refilled with hot tap water and 190 grams of the soiling mixture. The machine was cycled once through the cleaning cycle to soil the test pieces and the machine with the soiling mixture. After completion of the cleaning cycle the machine reservoir was drained.

The machine reservoir was refilled with hot tap water and a sufficient amount of a rinse aid added to the water to create a rinse solution containing the lowest concentration of the rinse aid to be investigated. The machine was manually operated on the clean cycle for a defined time period and then stopped. A 100 watt lightbulb was directed onto the test pieces and the extent of sheeting observed. The sequence of operation, termination and observation was repeated as necessary to permit observation of sheeting on all test pieces. Additional rinse aid was then added to the rinse solution to increase the concentration of rinse aid in the solution and the sequence of operation, termination and observation repeated. Increases in the concentration of rinse aid and observations as to the sheeting performance of the rinse aid solution at that concentration were repeated until the sheeting performance of the rinse aid over the concentration range of interest had been observed.

Recording of Data and Calculations

Sheeting is defined as a thin film of water flowing as a single continuous coating down a surface under the influence of gravity. Lack of sheeting results in the formation of water droplets on the surface as the water flows down the surface under the influence of gravity. Sheeting can frequently be accompanied by a "pinholing effect" caused by the bursting of small bubbles on the surface.

Observations as to the sheeting effect obtained by the rinse solutions were scored upon a scale of 0 for no sheeting, 1 for partial sheeting, and 2 for full sheeting.

Results of the sheeting performance testing for compositions 1–14 of Table 1 are set forth below in Table 2.

TABLE 3

| Comp # | ppm | MP | CP | GS | SK | SS | GT |
|---|---|---|---|---|---|---|---|
| 1 | 50 | 0 | 0 | 0 | 0 | 0 | 0 |
| 1 | 100 | 0 | 1 | 0 | 1 | 1 | 0 |
| 1 | 150 | 0 | 2 | 1 | 1 | 2 | 1 |
| 1 | 200 | 1 | 2 | 2 | 2 | 2 | 2 |
| 2 | 100 | 0 | 0 | 0 | 0 | 0 | 0 |
| 2 | 150 | 0 | 1 | 0 | 0 | 1 | 0 |

TABLE 3-continued

| Comp # | ppm | MP | CP | GS | SK | SS | GT |
|---|---|---|---|---|---|---|---|
| 2 | 200 | 2 | 1 | 0 | 1 | 2 | 0 |
| 2 | 100 | 0 | 0 | 0 | 0 | 0 | 0 |
| 2 | 150 | 0 | 1 | 1 | 1 | 1 | 1 |
| 2 | 200 | 1 | 2 | 2 | 2 | 2 | 2 |
| 3 | 100 | 0 | 0 | 0 | 0 | 0 | 0 |
| 3 | 150 | 0 | 1 | 1 | 0 | 0 | 0 |
| 3 | 200 | 1 | 2 | 2 | 1 | 1 | 2 |
| 3 | 250 | 2 | 2 | 2 | 2 | 2 | 2 |
| 3 | 100 | 0 | 0 | 0 | 0 | 0 | 0 |
| 3 | 150 | 0 | 1 | 1 | 1 | 1 | 0 |
| 3 | 200 | 0 | 2 | 1 | 2 | 2 | 1 |
| 3 | 250 | 1 | 2 | 2 | 2 | 2 | 2 |
| 4 | 100 | .5 | — | — | — | — | — |
| 4 | 150 | 1 | 1.5 | 1.5 | 1.5–2 | 2 | 2 |
| 4 | 200 | 2 | 2 | 1.5 | 1.5–2 | 2 | 2 |
| 4 | 250 | 2 | 2 | 1.5–2 | 2 | 2 | 2 |
| 6 | 100 | 1 | 1 | 0.5 | 0.5 | 1 | 0.5 |
| 6 | 150 | 1.5 | 1.5 | 1 | 1 | 1.5 | 1 |
| 6 | 200 | 2 | 2 | 1.5 | 1.5 | 2 | 1.5 |
| 6 | 250 | 2 | 2 | 2 | 2 | 2 | 2 |
| 7 | 100 | 0 | 0 | 0 | 0 | 0 | 0 |
| 7 | 200 | 0.5 | 0 | 0 | 0 | 0 | 0 |
| 7 | 300 | 1 | 1 | 0 | 0 | 1 | 0 |
| 7 | 400 | 1.5 | 15 | 0 | 09 | 1.5 | 0.5 |
| 7 | 500 | 2 | 1.8 | 1 | 1 | 2 | 1 |
| 8 | 100 | 0 | 1 | 0 | 0 | 0 | 0 |
| 8 | 200 | 0 | 1 | 0 | 0 | 1.5 | 0 |
| 8 | 300 | 1.5 | 2 | 0.5 | 0.5 | 2 | 0.5 |
| 8 | 400 | 2 | 2 | 1 | 0.5 | 2 | 1 |
| 8 | 450 | 2 | 2 | 2 | 1.5 | 2 | 2 |
| 14 | 100 | 0 | 0 | 0 | 0 | 0 | 0 |
| 14 | 200 | 1 | 0 | 0 | 0 | 1 | 0 |
| 14 | 300 | 1.5 | 0.5 | 0 | 0.5 | 1.5 | 0 |
| 14 | 400 | 2 | 1.5 | 1 | 1 | 2 | 1 |
| 14 | 475 | 2 | 2 | 2 | 2 | 2 | 2 |

Foaming

Test Procedure

Figure 2:
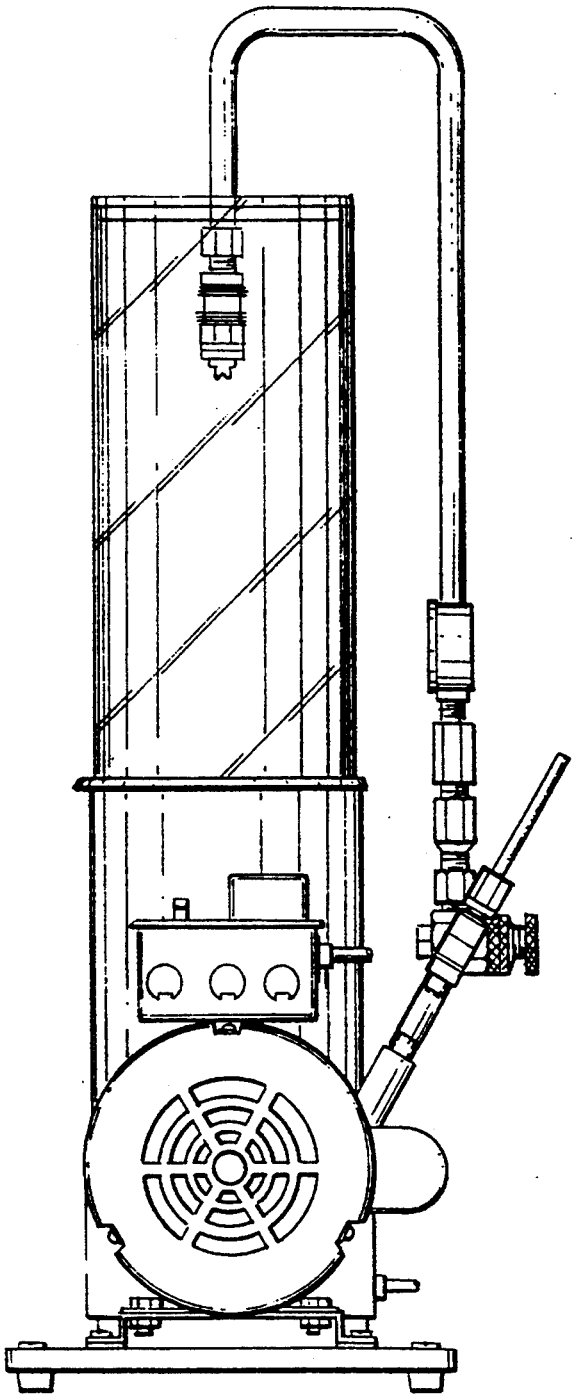

Foaming tendency was measured in a Glewwe TM Foaming Apparatus which is depicted in attached FIGS. 1 and 2. The apparatus circulates liquid from an 8 inch (diameter) by 12 inch (height) glass cylinder through piping equipped with a pressure regulator and then returns the liquid to the cylinder through a vee jet spray nozzle using a 1/5 horsepower electric recirculating pump (Model D-11, type 450, style #CZZ1GAVAT, Eastern Pump having a 3450 rpm capacity and operable at 115 V/60 HZ).

Rinse the Glewwe TM Foaming Apparatus with water by filling the cylinder with hot city water and pumping the water through the apparatus. Drain the rinse water from the apparatus after completion of the rinse cycle by opening the gate valve. If foam was generated during rinsing, the rinse cycle was repeated until no foam was generated in the apparatus.

Close the gate valve and fill the cylinder with hot tap water to the zero level at the base of the ruler through the top of the cylinder. Pump the water through the apparatus while adjusting the temperature of the water to 160° F. by adding an appropriate quantity of hot or cold city water. Adjust the pressure of the water pumped into the cylinder to 6 psig by rotating the knob located immediately below the pressure gauge. Stop the pump and readjust the water level to zero on the scale (3 liters).

Reactivate the pump and permit the pump to cycle water through the apparatus until the pressure stabilizes at 6 psig. Add 0.3 grams of the rinse additive to be evaluated into the water and start the stopwatch. Allow the pump to operate continuously for six minutes while measuring and recording the foam height every minute. After six minutes stop the pump and record the decrease in foam height every 15 seconds for one minute.

Drain the apparatus by opening the gate valve.

TABLE 4

| Composition # | Time (min) | Foam Generation (inches) | Foam Decay (inches) |
|---|---|---|---|
| 1 | 1.0 | 4.0 | |
| | 2.0 | 4.0 | |
| | 3.0 | 3.5 | |
| | 4.0 | 3.5 | |
| | 5.0 | 3.0 | |
| | 6.0 | 3.0 | |
| | 6.25 | | 2.5 |
| | 6.5 | | 2.0 |
| | 6.75 | | 1.5 |
| | 7.0 | | 1.0 |
| 2 | 1.0 | 2.75 | |
| | 2.0 | 3.0 | |
| | 3.0 | 3.5 | |
| | 4.0 | 3.5 | |
| | 5.0 | 3.5 | |
| | 6.0 | 3.5 | |
| | 6.25 | | 3.0 |
| | 6.5 | | 2.5 |
| | 6.75 | | 2.0 |
| | 7.0 | | 1.75 |

Dispensing

Test Procedure

Into a SOL ET TM rinse additive dispenser manufactured by Ecolab, Inc. of St. Paul, Minn. (described below) was placed a cup-shaped plug of a rinse additive. The rinse water directed to the spray nozzle was placed under a pressure of 5 psig and heated to a temperature of 165° F. The rinse water was repeatedly sprayed upon the plug for a period of 10 seconds with the plug removed form the dispenser and weighed upon an analytical balance after each spraying. The net weight gain or loss for the plug was recorded for each weighing.

SOL ET TM Dispenser

The dispenser employed a 2.5 mm diameter plastic support screen having approximately 7 mm sized square openings and a #5.6–90° spray head with a distance from the screen to the spray head of about 40 mm.

TABLE 5

| Spray # | Plug weight (+ gain/− loss) (grams) | Observations |
|---|---|---|
| | Composition # One Initial wt of plug 151.5 grams | |
| 1 | +1.2 | |
| 2 | +0.2 | |
| 3 | −0.4 | |
| 4 | −0.6 | |
| 5 | −0.7 | |
| 6 | −0.7 | |
| 7 | −0.5 | |
| 8 | −0.7 | |
| 9 | −0.6 | |
| 10 | −0.7 | |
| 11–15 | −3.9 (total) | Plug mushroomed at the base and pressed into screen. Plug was very soft but remained intact. |
| | Composition # Two Initial wt of plug 298 grams | |
| 1 | +0.8 | |
| 2 | −0.1 | |

TABLE 5-continued

| Spray # | Plug weight (+ gain/− loss) (grams) | Observations |
|---|---|---|
| 3 | −0.3 | |
| 4 | −0.5 | |
| 5 | −0.6 | |
| 6 | −0.6 | |
| 7 | −0.6 | |
| 8 | −0.8 | |
| 9 | −0.8 | |
| 10 | −0.7 | |
| 11–15 | −3.8 (total) | Plug mushroomed at the base and pressed into screen. Plug was very soft but remained intact. |
| | Composition # Eleven Initial wt of plug 250 grams | |
| 1 | +1.0 | |
| 2 | −0.35 | |
| 3 | −0.39 | |
| 4 | −0.48 | |
| 5 | −0.47 | |
| 6 | −0.57 | |
| 7 | −0.66 | |
| 8 | −0.62 | |
| 9 | −0.63 | |
| 10–14 | −3.7 (total) | 1370 ml water utilized in sprays 10–14. Very little product remained attached to screen when plug removed for weighing after each cycle. |
| | Composition # Thirteen Initial wt of plug 250 grams | |
| 1 | −1.4 | |
| 2 | −1.9 | |
| 3 | −2.2 | Plug becoming very soft. Residue starting to remain on the screen when plug removed for weighing. |
| 4 | −3.0 | |
| 5 | −2.5 | |
| 6 | −1.51 | Edges of plug extremely soft. Increased amounts of plug remaining on the screen. |
| 7 | −2.18 | |
| 8 | −2.27 | |
| 9 | −1.96 | |
| 10 | | Plug fell off holder. |
| 11–15 | −10.85 (total) | 1365 ml water utilized in sprays 11–15. Significant amounts of plug remained attached to screen. Plug expected to fall through screen at any time. |

I claim:

1. A rinse aid composition comprising a substantially homogeneous cast solid block consisting essentially of:

(a) about 2 to 20 wt-% of a sorbitan fatty acid ester; and (b) at least about 35 wt-% to the maximum effective rinse amount of a sucrose fatty acid ester; wherein the maximum carbon chain length of the sorbitan fatty acid ester is 24; the solid composition has a melt point of greater than 100° F. (about 38° C.) so as to form a block under ambient conditions; and the sorbitan fatty acid ester and sucrose fatty acid ester are the sole surfactant components in the composition.

2. The rinse aid of claim 1 wherein the sorbitan fatty acid ester is a sorbitan monocaprylic ester.

3. The rinse aid of claim 1 wherein the sucrose fatty acid ester includes a major proportion of sucrose monopalmitate.

4. A rinse aid composition comprising a substantially homogeneous cast solid block consisting essentially of:

(a) an effective sheeting and foam-controlling amount of a sorbitan fatty acid ester;

(b) an effective sheeting and rinsing amount of a sucrose fatty acid ester; and (c) an effective sheeting and rinsing amount of a polyglycerol fatty acid ester;

wherein the maximum carbon chain length of the sorbitan fatty acid ester is 24, the relative amounts of the sorbitan fatty acid ester, sucrose fatty acid ester, and polyglycerol fatty acid ester are effective to form a solid composition which has a melt point of greater than 100° F. (about 38° C.) so as to form a block under ambient conditions and wherein the sorbitan fatty acid ester, sucrose fatty acid ester and polyglycerol fatty acid ester are the sole surfactant components present in the composition.

5. The rinse aid of claim 4 wherein the composition consists essentially of:

(a) about 2 to 20 wt-% of the sorbitan fatty acid ester, (b) about 35 to 65 wt-% of the sucrose fatty acid ester; and (c) about 2 to 20 wt % of the polyglycerol fatty acid ester.

6. A rinse aid composition comprising a substantially homogeneous cast solid block consisting essentially of:

(a) about 2 to 20 wt-% of a sorbitan fatty acid ester;

(b) at least about 35 wt-% to the maximum effective rinse amount of a sucrose fatty acid ester; and (c) about 2 to 20 wt-% of a polyglycerol fatty acid ester;

wherein the maximum carbon chain length of the sorbitan fatty acid ester is 24; the solid composition has a melt point of greater than 100° F. (about 38° C.) so as to form a block under ambient conditions.; and the sorbitan fatty ester, sucrose fatty acid ester, and polyglycerol fatty acid ester are the sole surfactant components in the composition.

7. The rinse aid of claim 6 wherein the sucrose fatty acid ester includes a major proportion of a sucrose monopalmitate.

8. The rinse aid of claim 6 wherein the sorbitan fatty acid ester is a sorbitan monocaprylic ester.

9. The rinse aid of claim 6 wherein the polyglycerol fatty acid ester is a decaglycerol monolauric ester.

10. A rinse aid composition comprising a substantially homogeneous cast solid block consisting essentially of:

(a) an effective sheeting and foam-controlling amount of a sorbitan fatty acid ester;

(b) an effective sheeting and rinsing amount of a sucrose fatty acid ester; and (c) an effective sheeting and rinsing amount of a polyglycerol fatty acid ester comprising a monolauric ester;

wherein the maximum carbon chain length of the sorbitan fatty acid ester is 24, the relative amounts of the sorbitan fatty acid ester, sucrose fatty acid ester, and polyglycerol fatty acid ester are effective to form a solid composition which has a melt point of greater than 100° F. (about 38° C.) so as to form a block under ambient conditions and wherein the sorbitan fatty acid ester, sucrose fatty acid ester and polyglycerol fatty acid ester are the sole surfactant components present in the composition.

11. The rinse aid of claim 10 wherein the sucrose fatty acid ester includes a major proportion of a sucrose monopalmitate.

12. The rinse aid of claim 10 wherein the sorbitan fatty acid ester is a sorbitan monocaprylic ester.

13. The rinse aid of claim 10 wherein the polyglycerol fatty acid ester is a decaglycerol monolauric ester.

14. A rinse aid composition comprising a substantially homogeneous cast solid block consisting essentially of:

(a) about 2 to 20 wt-% of a sorbitan fatty acid ester comprising a sorbitan monocaprylic ester; and (b) at least about 35 wt-% to the maximum effective rinse amount of a sucrose fatty acid ester; wherein the maximum carbon chain length of the sorbitan fatty acid ester is 24; the solid composition has a melt point of greater than 100° F. (about 38° C.) so as to form a block under ambient conditions; and the sorbitan fatty acid ester and the sucrose fatty acid ester are the sole surfactant components in the composition.

15. A solid rinse aid composition comprising a substantially homogeneous cast solid block consisting essentially of:

(a) about 2 to 20 wt-% of a sorbitan caprylate ester;

(b) at least about 35 wt-% to the maximum effective rinse amount of a sucrose fatty acid ester which includes a major proportion of a sucrose monopalmitate; and (c) about 2 to 20 wt-% of a sorbitan laurate ester; wherein the maximum carbon chain length of the sorbitan fatty acid ester is 24; the solid composition has a melt point greater than 100° F. (about 38° C.) so as to form a block under ambient conditions; and the sorbitan caprylate ester, sucrose fatty acid ester, and sorbitan laurate ester are the sole surfactant components in the composition.

* * * * *